US008769760B2

(12) United States Patent
Chen

(10) Patent No.: US 8,769,760 B2
(45) Date of Patent: Jul. 8, 2014

(54) MULTI-HEAD DUST MOP

(75) Inventor: Lang Chen, Guangzhou (CN)

(73) Assignee: Guangdong Minglang Life Products Manufacturing Co., Ltd., Guangzhou (CN)

( * ) Notice: Subject to any disclaimer, the term of this patent is extended or adjusted under 35 U.S.C. 154(b) by 303 days.

(21) Appl. No.: 13/354,792

(22) Filed: Jan. 20, 2012

(65) Prior Publication Data

US 2012/0186033 A1 Jul. 26, 2012

(30) Foreign Application Priority Data

Jan. 21, 2011 (CN) ..... 2011 2 0020198 U

(51) Int. Cl.
*A47L 13/24* (2006.01)
*A47L 13/254* (2006.01)

(52) U.S. Cl.
CPC ..... *A47L 13/254* (2013.01)
USPC ..... 15/228; 15/229.3; 15/209.1

(58) Field of Classification Search
USPC ..... 15/220, 229.3, 229.6, 209.1, 228, 15/209.18
See application file for complete search history.

(56) References Cited

U.S. PATENT DOCUMENTS 6,029,308 A * 2/2000 Smith ..... 15/229.2
6,588,956 B1 * 7/2003 Gennuso, Jr. ..... 401/23
2009/0279938 A1 * 11/2009 Rosenzweig et al. ..... 401/268

* cited by examiner

*Primary Examiner* — Shay Karls
(74) *Attorney, Agent, or Firm* — Muncy, Geissler, Olds & Lowe, P.C.

(57) ABSTRACT

A multi-head Dust mop including a bracket, a joint and a connecting rod, wherein at least two cleaning heads are arranged at the bottom circumference of the bracket; the bottom circumference of the bracket has a fastening shaft matched with the cleaning heads; the fastening shaft consists of a number of elastic fasteners; the bottom of the outer surface of each elastic fastener has a flange protruding outwards; and the cleaning heads are sleeved on the fastening shaft and limited between the flanges and the lower surface of the bracket. Several cleaning heads are capable of completely cleaning narrow corners. The connecting rod, and the cleaning heads are capable of respectively rotating in two directions. The installation of the multi-head Dust mop is completed by pressing the springs of the parts.

8 Claims, 4 Drawing Sheets

MULTI-HEAD DUST MOP

BACKGROUND OF THE INVENTION

1. Technical Field

The present invention belongs to the category of sanitary wares and discloses a multi-head Dust mop.

2. Description of Related Art

With the continuous improvement of living standards, people have higher requirements on indoor cleanliness. At present, all tools for indoor cleaning, such as mops, dust collectors, sweepers, etc., consist of a rod, of which the length is adaptive to the human height, and a cleaning assembly. The traditional cleaning tools only have one cleaning assembly and are inoperable when cleaning dead corners; the user has to move several times to completely clean dead corners; Furthermore, the rod and cleaning assembly of the traditional cleaning tool are fixedly connected, which means the rod and the cleaning assembly at the bottom of the rod fail to rotate relatively, so the fixed connection mode limits the performance of the cleaning tool to a large extent when cleaning some dead corners.

To solve the mentioned problems, the rod bottoms and the cleaning assemblies of some cleaning tools are hinged, making them capable of realizing an angular change in one plane, but still failing to meet peoples' use requirements.

BRIEF SUMMARY OF THE INVENTION

To overcome the defects of the prior art, the present invention aims to provide a multi-head Dust mop that is capable of changing the head angle flexibly and realizing cleaning which is convenient to use without requiring movement many times.

To fulfill the mentioned aim, the present invention adopts the following technical scheme:

A multi-head Dust mop comprises a bracket, a joint, and a connecting rod, wherein at least two cleaning heads are arranged at the bottom circumference of the bracket; the bottom circumference of the bracket has a fastening shaft matched with the cleaning heads; the fastening shaft consists of a number of elastic fasteners; the bottom of the outer surface of each elastic fastener has a flange protruding outwards; and the cleaning heads are sleeved on the fastening shaft and limited between the flanges and the lower surface of the bracket.

The cleaning head comprises an upper shell and a lower shell that is positioned at the bottom of the upper shall, the upper shell has a mounting hole through which the fastening shaft passes, a limiting wall is arranged on the circumference of the mounting hole on the lower surface of the upper shell, the bottom face of the limiting wall is leveled with the upper surface of the flange, and the lower shell is provided with a limiting column that is inserted into the fastening shaft.

The bottom face of the lower shell is provided with a number of hook-and-loop tapes, and the hook-and-loop tapes are adhered to the bottom face of the lower shell.

The lower shell is fastened on the lower part of the upper shell.

The upper shell and the lower shell are integrally molded.

The cleaning heads are square, triangular or round.

The hook-and-loop tapes and the lower shell are integrally molded.

The upper surface of the bracket is provided with a connecting base with two plate-like portions, the inner sides of the two plate-like portions are respectively provided with a shaft groove, the two ends of the connecting base are respectively inserted into rotating shafts in the two shaft grooves, the upper end of the connecting base is provided with a shaft hole, and the bottom of the connecting rod is provided with a shaft head which pivots in the shaft hole.

The connecting base is U-shaped, the two sides of the bottom of the connecting rod have respective recessed portions, the distance between the bottom walls of the two recessed portions is equal to that of the inner space of the U-shaped side wall of the U-shaped connecting base, the shaft hole runs through the U-shaped side wall of the connecting base, and the two shaft heads are respectively positioned on the bottom walls of the two recessed portions.

The bottom of the recessed portion is an elastic plate, the upper end of the elastic plate is connected with the main body portion of the connecting rod, and the shaft head is positioned at the bottom of the elastic plate.

The inner side of the plate-like portion on the upper part of the shaft groove is provided with a chute, with the bottom wall gradually inclining outwards from the bottom up.

The invention has the following advantages:

compared with the prior art, the invention is convenient and easy to use; several cleaning heads are capable of cleaning narrow corners well, which greatly improves the working efficiency of the cleaning staff and makes the environment cleaner; moreover, the connecting rod and the cleaning heads are capable of respectively rotating in two directions; meanwhile, the installation of the multi-head Dust mop is easily and conveniently completed by means of simply pressing the springs of the parts.

DETAILED DESCRIPTION OF THE INVENTION

Figure 1:
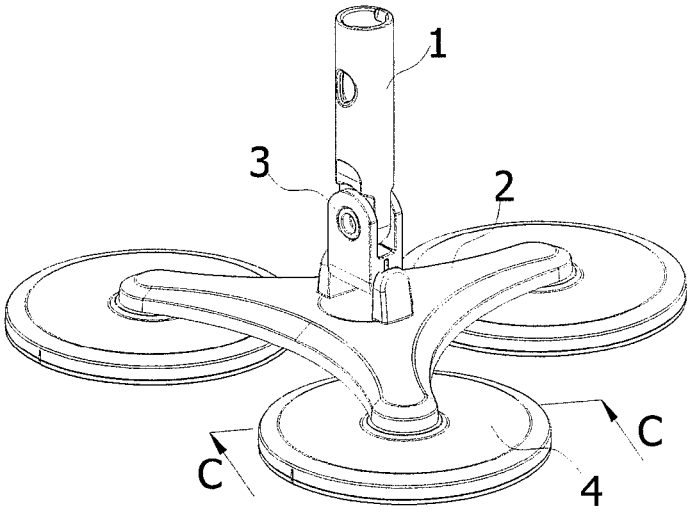
FIG. 1 is a structure schematic view of a multi-head Dust mop of the present invention.
Figure 2:
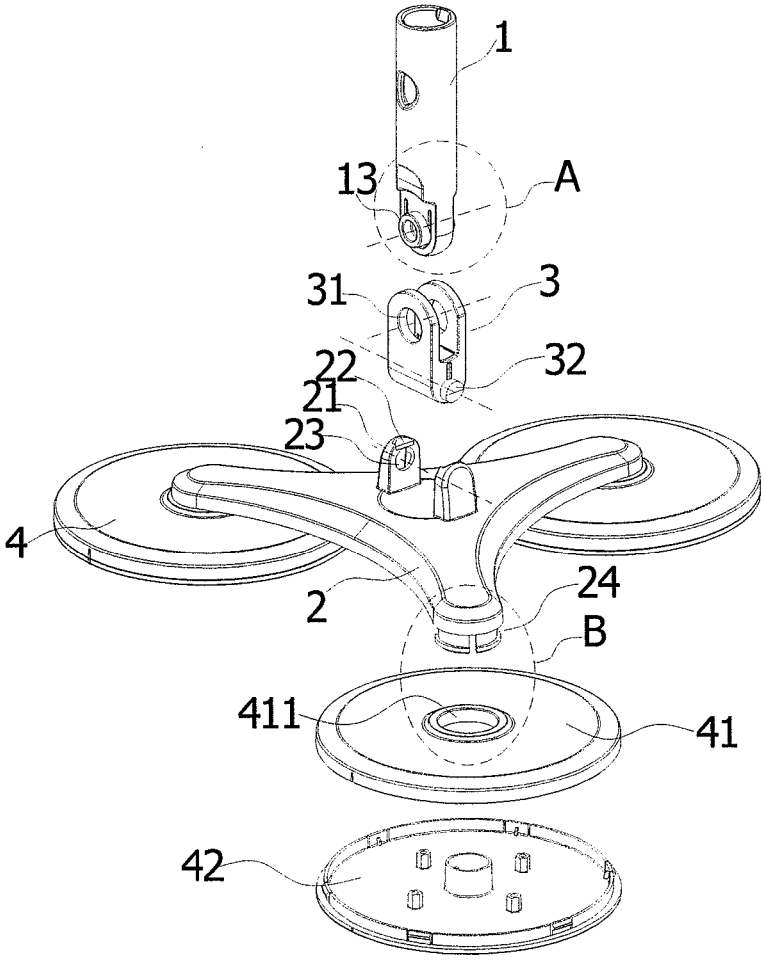
FIG. 2 is an installation schematic view of the multi-head Dust mop as shown in FIG. 1.
Figure 3:
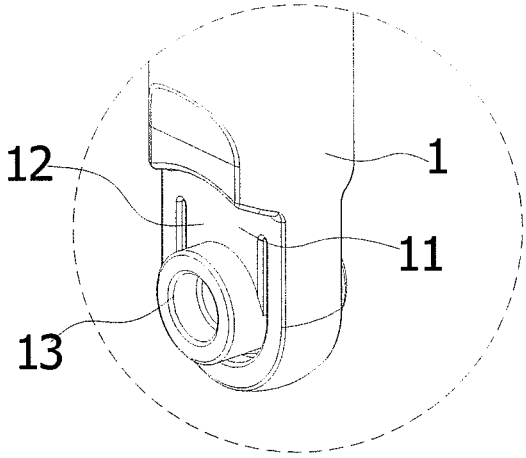
FIG. 3 is an enlarged view of position A in FIG. 2.
Figure 4:
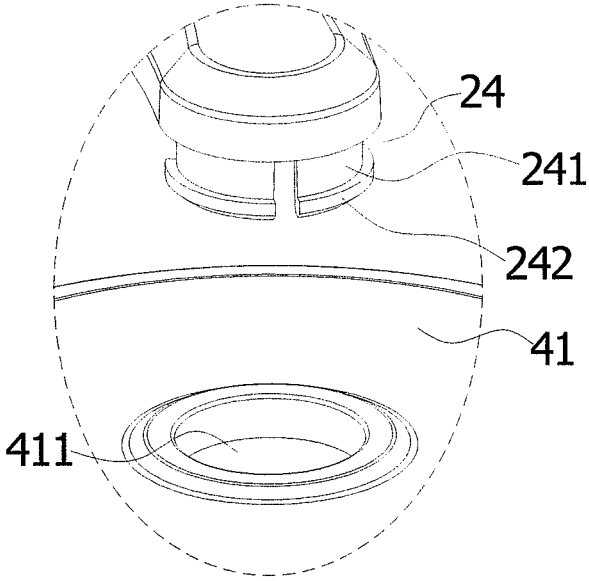
FIG. 4 is an enlarged view of position B in FIG. 2.
Figure 5:
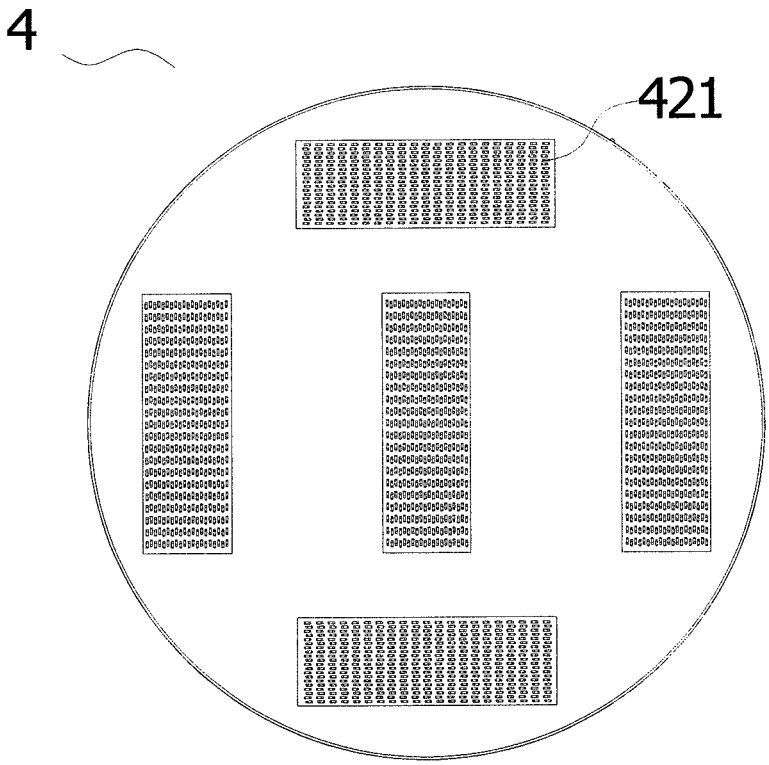
FIG. 5 is a schematic view of the bottom face of the cleaning head as shown in FIG. 2.
Figure 6:
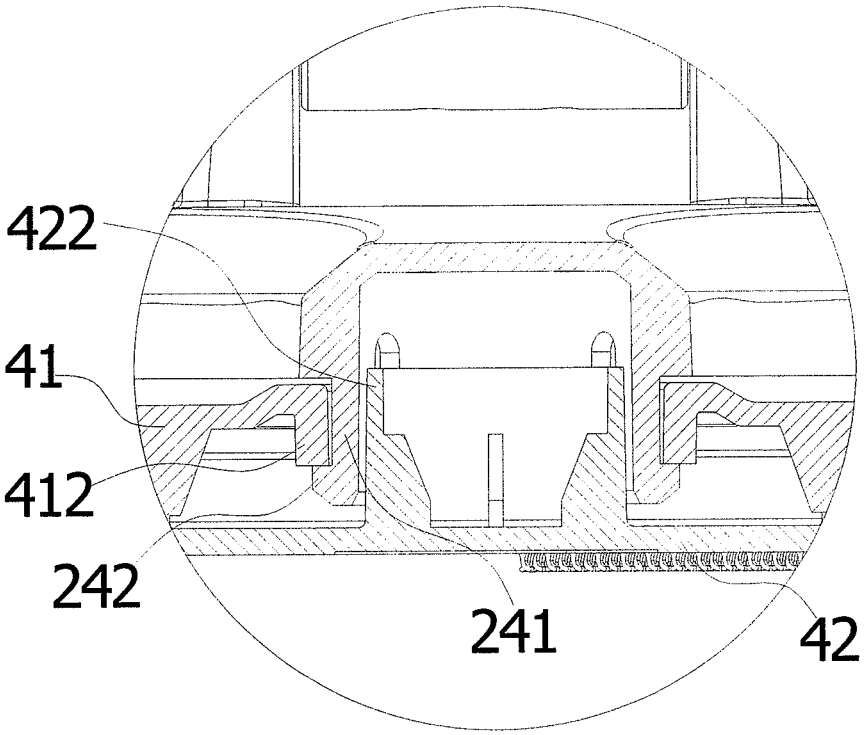
FIG. 6 is a sectional view of C-C in FIG. 1.

The present invention is further described in detail by combining the attached drawings and the embodiments.

FIGS. 1, 2, 3, 4, 5 and 6 show a multi-head Dust mop comprising a bracket 2, a joint 3, and a connecting rod 1, wherein three cleaning heads 4 are arranged at the bottom circumference of the bracket 2 at an equal interval; each cleaning head 4 comprises an upper shell 41 positioned on the upper part of the cleaning head and a lower shell 42 fastened on the lower part of the upper shell 41; the lower surface of the lower shell 42 are provided with hook-and-loop tapes 421, and the upper shell 41 has a mounting hole 411; the circumferential lower part of the bracket 2 is provided with a fastening shaft 24 corresponding to the mounting hole 411; the fastening shaft 24 consists of a number of elastic fasteners 241, and the bottom circumferences of the elastic fasteners 241 are provided flanges 242 protruding outwards; the fastening shaft 24 is inserted into the mounting hole 411; the upper shell 41 is limited between the bottom face of the bracket 2 and the flange 242; the elastic fasteners 241 deform during installation and spring back into their original state after installation; and the flanges 242 are positioned below the bottom of the upper shell 41. To further facilitate installation, the circumference of the lower surface of the upper shell 41 around the mounting hole 411 is provided with a limiting wall 412, of which the bottom face is leveled with the upper surface of the flange 242, and the upper surface of the lower shell 42 is provided with a limiting column 442 that is inserted into the fastening shaft 24 and is capable of preventing excessive deformation of the elastic fasteners 241 during installation.

In the present invention, the quantity of the cleaning heads 4 is determined according to the concrete requirement, but is at least two; at least one of the cleaning heads 4 is able to rotate with respect to the bracket 2, so during use, when one of the cleaning heads 4 rotates, it is able to drive the other two cleaning heads 4 to rotate; all the cleaning heads 4 are also able to rotate with respect to the bracket 2.

The upper shell 41 and the lower shell 42 are fastened, and the two may be integrally molded to facilitate processing.

The cleaning heads 4 may be square, triangular, round, polygonal, or irregularly shaped. Furthermore, the hook-and-loop tapes 421, for example Velcro tapes, are adhered to the bottom face of the lower shell 42 and are capable of being replaced with new ones to ensure cleaning efficiency after being used for a long time. Of course, the hook-and-loop tapes 421 may also be integrated with the lower shell 42 by injection.

The bracket 2 is hinged with the bottom of the joint 3, and the bracket and the joint 3 are capable of randomly rotating in the planes vertical to the rotating shafts thereof; the connecting rod 1 is hinged with the upper end of the joint 3, and the connecting rod 1 and the joint 3 are capable of randomly rotating in the planes vertical to the rotating shafts thereof; by random rotation, some narrow dead corners which would be difficult to clean are capable of being cleaned. The following is the concrete structure:

The joint 3 is U-shaped, the upper end thereof has a shaft hole 31 that runs through the U-shaped walls, the two sides of the bottom of the connecting rod 1 are respectively provided with a recessed portion 11, the distance between the bottom walls of the two recessed portions 11 is equal to that of the inner space of the U-shaped walls of the joint 3, the two sides of each recessed portion 11 are provided with respective shaft heads 13, and the two shaft heads 13 are coaxial and inserted into the shaft hole 31 to hinge the joint 3 to the connecting rod 1; to facilitate installation in this invention, the bottom wall of each recessed portion 11 is configured to be a spring plate 12, of which the upper end is connected with the upper end of the connecting rod 1 and the lower end is formed into an elastic free end, and the two shaft heads 13 are respectively positioned at the lower free ends of the two spring plates 12; during installation, the lower end of the connecting rod 1 is correspondingly inserted between the U-shaped side walls of the joint 3, the shaft heads 13 are pressed by the U-shaped side walls of the joint 3, and the spring plates 12 deform; when the shaft heads 13 reach the shaft hole 31 and the spring plates 12 spring back, the shaft heads 13 are completely embodied into the shaft hole 31 to realize installation of the connecting rod 1 and the joint 3 and to keep the connecting rod 1 and the joint 3 from falling.

The two ends of the bottom of the joint 3 are provided with respective rotating shafts 32, the two rotating shafts 32 are coaxial, the upper surface of the bracket 2 has a connecting base with two plate-like portions 21 in parallel, the inner sides of the two plate-like portions 21 are respectively provided with a shaft groove 23, and the two shaft grooves 23 are coaxial and the two rotating shafts 32 are respectively inserted into the two shaft grooves 23 to hinge the joint 3 to the bracket 2. Meanwhile, to facilitate installation, the plate-like portions 21 are provided with respective chutes 22 positioned on the upper part of each shaft groove 23 and gradually inclining outwards from the bottom up; during installation, the joint 3 is inserted downwards between the two plate-like portions 21, and the rotating shafts 32 slide downward in the chutes 22 to make the plate-like portions 21 deform; when the rotating shafts 32 fall into the shaft grooves 23, the plate-like portions 21 spring back, and the shaft grooves 23 hold the rotating shafts 32 to keep the joint 3 and the bracket 2 from falling.

Figure 7:
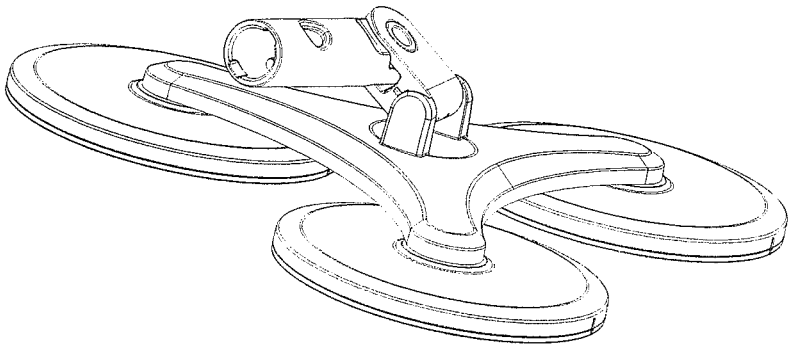
FIG. 7 is a schematic view of the use state of the multi-head Dust mop as shown in FIG. 1.

As shown in FIG. 7, during use, the multi-head Dust mop is able to perform multi-angle rotation; after rotation and deformation, the cleaning heads 4 are able to extend to some dead corners which would be difficult to clean, so the operator is capable of easily realizing cleaning without the need to bend.

Common skilled persons in field would be able to provide all kinds of changes and deformations, which shall be within the protection scope of the claims of the present invention according to the mentioned technical schemes and conception.

What is claimed is:

1. A multi-head dust mop, comprising:

a bracket, a joint, a connecting rod, at least two cleaning heads arranged at a bottom circumference of the bracket;

the bottom circumference of the bracket having a fastening shaft matched with each of the cleaning heads;

each fastening shaft consists of a number of elastic fasteners; a bottom of an outer surface of each elastic fastener has a flange protruding outwards;

the cleaning heads are sleeved on the fastening shaft and limited between the flanges and the lower surface of the bracket;

wherein each cleaning head comprises an upper shell and a lower shell that is positioned at a bottom of the upper shell, wherein the upper shell has a mounting hole through which the fastening shaft passes, a limiting wall is arranged on the circumference of the mounting hole on a lower surface of the upper shell, a bottom face of the limiting wall is leveled with an upper surface of the flange, and the lower shell is provided with a limiting column that is inserted into the fastening shaft;

wherein an upper surface of the bracket is provided with a connecting base with two plate-like portions, wherein inner sides of the two plate-like portions are each provided with a shaft groove, two ends of the joint are each inserted into rotating shafts in the two shaft grooves, the upper end of the joint is provided with a shaft hole, and the bottom of the connecting rod is provided with a shaft head pivoted in the shaft hole;

wherein the joint is U-shaped, two sides of the bottom of the connecting rod have respective recessed portions, the distance between the bottom walls of the two recessed portions is equal to that of the inner space of the U-shaped side wall of the U-shaped joint, the shaft hole runs through the U-shaped side wall of The joint, and the two shaft heads are respectively positioned at the bottom walls of the two recessed portions.

2. The multi-head dust mop according to claim 1, wherein the bottom face of the lower shell is provided with a number of hook-and-loop tapes, and the hook-and-loop tapes are adhered to the bottom face of the lower shell.

3. The multi-head dust mop according to claim 2, wherein the hook-and-loop tapes and the lower shell are integrally molded.

4. The multi-head dust mop according to claim 1, wherein the lower shell is fastened on the lower part of the upper shell.

5. The multi-head dust mop according to claim 1, wherein the upper and lower shells are integrally molded.

6. The multi-head dust mop according to claim 1, wherein the cleaning heads are square, triangular or round.

7. The multi-head dust mop according to claim 1, wherein a bottom of the recessed portion is an elastic plate, an upper end of the elastic plate is connected with the main body portion of the connecting rod, and each shaft head is positioned at the bottom of the elastic plate.

8. The multi-head dust mop according to claim 1, wherein the inner side of the plate-like portion on the upper part of the shaft groove is
provided with a chute, with the bottom wall gradually inclining outwards from the bottom up.

* * * * *